US006793321B2

(12) United States Patent
Fujimori

(10) Patent No.: US 6,793,321 B2
(45) Date of Patent: Sep. 21, 2004

(54) PRINT CONTROL APPARATUS, PRINT CONTROL METHOD, AND MEDIUM STORING PRINT CONTROL PROGRAM

(75) Inventor: Yukimitsu Fujimori, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 108 days.

(21) Appl. No.: 10/292,362

(22) Filed: Nov. 12, 2002

(65) Prior Publication Data

US 2003/0142154 A1 Jul. 31, 2003

(30) Foreign Application Priority Data

Nov. 13, 2001 (JP) ..... 2001-347664

(51) Int. Cl.[7] ..... B41J 2/145
(52) U.S. Cl. ..... 347/41; 347/14
(58) Field of Search ..... 347/41, 16, 37, 347/14, 19

(56) References Cited

U.S. PATENT DOCUMENTS 6,247,788 B1 * 6/2001 Kamei ..... 347/41
6,644,783 B1 * 11/2003 Tsuruoka ..... 347/41

* cited by examiner

*Primary Examiner*—Lamson D Nguyen
(74) *Attorney, Agent, or Firm*—Sughrue Mion, PLLC

(57) ABSTRACT

Printing with one nozzle is liable to cause banding, whereas printing with more than one nozzle to prevent banding is slow in printing speed.

The print control apparatus performs the image judging processing as the preliminary processing for the dot-forming control processing, and it generates the printing condition to specify whether to perform printing in the normal mode for each image line or to perform printing in the overlap mode for each image line. And, it performs the rasterizing on the basis of this printing condition. If it prints in the overlap mode the image line containing print pixels (such as black pixels and pixels having approximately the same resolution) subject to banding, then it is possible to prevent the occurrence of banding even though other image lines are printed at a high speed in the ordinary printing manner. Therefore, it permits high-quality high-speed printing.

20 Claims, 20 Drawing Sheets

| Pass | | | | 1 | 2 | 3 | 4 |
|---|---|---|---|---|---|---|---|
| | | | | | | | |
| | | | | 1 | | | |
| | | | | | | | |
| | | | | 2 | | | |
| | | | | | | | |
| | | | | 3 | | | |
| | | | | | | | |
| Image | | 1 | | 4 | | | |
| | | 2 | | | 1 | | |
| | | 3 | | 5 | | | |
| | | 4 | | | 2 | | |
| | | 5 | | 6 | | | |
| | | 6 | | | 3 | | |
| | | 7 | | 7 | | | |
| | | 8 | | | 4 | | |
| | | 9 | | | | 1 | |
| | | 10 | | | 5 | | |
| | | 11 | | | | 2 | |
| | | 12 | | | 6 | | |
| | | 13 | | | | 3 | |
| | | 14 | | | 7 | | |
| | | 15 | | | | 4 | |
| | | 16 | | | | | 1 |
| | | 17 | | | | 5 | |
| | | 18 | | | | | 2 |
| | | 19 | | | | 6 | |
| | | 20 | | | | | 3 |
| | | 21 | | | | 7 | |
| | | 22 | | | | | 4 |
| | | 23 | | | | | |
| | | 24 | | | | | 5 |
| | | 25 | | | | | |
| | | 26 | | | | | 6 |
| | | 27 | | | | | |
| | | 28 | | | | | 7 |

FIG. 11

| Pass | | | | 1 | 2 | 3 | 4 | 5 | |
|---|---|---|---|---|---|---|---|---|---|
| | | | | | | | | | |
| | | | | 1 | | | | | Normal mode |
| | | | | | | | | | |
| | | | | 2 | | | | | |
| | | | | | 1 | | | | |
| | | | | 3 | | | | | |
| | | | | | 2 | | | | |
| | | | | 4 | | 1 | | | |
| | | | | | 3 | | | | |
| Image | | 1 | | 5 | | 2 | | | |
| | | 2 | | | 4 | | 1 | | Overlap mode |
| | | 3 | | 6 | | 3 | | | |
| | | 4 | | | 5 | | 2 | | |
| | | 5 | | 7 | | 4 | | 1 | |
| | | 6 | | | 6 | | 3 | | |
| | | 7 | | | | 5 | | 2 | |
| | | 8 | | | 7 | | 4 | | |
| | | 9 | | | | 6 | | 3 | |
| | | 10 | | | | | 5 | | |
| | | 11 | | | | 7 | | 4 | |
| | | 12 | | | | | 6 | | |
| | | 13 | | | | | | 5 | |
| | | 14 | | | | | 7 | | |
| | | 15 | | | | | | 6 | |
| | | 16 | | | | | | | |
| | | 17 | | | | | | 7 | |

FIG. 12

| Pass | 1 | 2 | 3 | 4 | 5 | 6 | 7 | 8 | 9 |
|---|---|---|---|---|---|---|---|---|---|
| Paper feed | 7 | 7 | 1 | 3 | 3 | 3 | 3 | 7 | 7 |
| Printing monitor | OFF | ON | ON | ON | ON | ON | ON | ON | OFF |
| First nozzle | All pixels | All pixels | All pixels | Non-eject | Non-eject | Even number | Non-eject | Non-eject | All pixels |
| Second nozzle | All pixels | All pixels | All pixels | Non-eject | Odd number | Even number | Non-eject | Non-eject | All pixels |
| Third nozzle | All pixels | All pixels | All pixels | Non-eject | Odd number | Non-eject | Non-eject | All pixels | All pixels |
| Fourth nozzle | All pixels | All pixels | Odd number | Even number | Odd number | Non-eject | Non-eject | All pixels | All pixels |
| Fifth nozzle | All pixels | All pixels | Odd number | Even number | Non-eject | All pixels | All pixels | All pixels | All pixels |
| Sixth nozzle | All pixels | All pixels | Odd number | All pixels | All pixels | All pixels | All pixels | All pixels | All pixels |
| Seventh nozzle | All pixels | All pixels | All pixels | All pixels | All pixels | All pixels | All pixels | All pixels | All pixels |

FIG. 14

PRINT CONTROL APPARATUS, PRINT CONTROL METHOD, AND MEDIUM STORING PRINT CONTROL PROGRAM

BACKGROUND OF THE INVENTION

1. Field of the Invention

The present invention relates to a print control apparatus, a print control method, and a medium storing a print control program. More particularly, the present invention relates to a print control apparatus to change the number of nozzles to be used, a print control method, and a medium storing a print control program.

2. Description of the Prior Art

A conventional method of color image printing involves scanning a print head having columnarly arranged nozzles to eject different color inks according to printing data. Printing in this manner produces image lines each consisting of pixels, and the number of nozzles corresponding to individual pixels is previously determined. If one nozzle is assigned to a certain color, each image line is printed with as many nozzles as color inks used. Likewise, if two nozzles are assigned to a certain color, each image line is printed with twice as many nozzles as color inks used. Increasing the number of nozzles constituting one line diminishes banding in full-overlap printing; however, this poses a problem with a decrease in printing speed.

SUMMARY OF THE INVENTION

The present invention was completed in view of the foregoing. It is an object of the present invention to provide a print control apparatus to change the number of nozzles to be used for each image line, a print control method, and a medium storing a print control program.

The invention to achieve the above-mentioned object is directed to a print control apparatus which causes a print head to print pixels constituting each image line during its primary scanning, said print head having columnarly arranged nozzles to eject different color inks according to printing data, said print control apparatus comprising an image line judging unit to judge whether or not a prescribed printing condition holds for the image line to be printed and a print control unit to change the number of nozzles to be used for printing each image line depending on whether or not said printing condition holds.

The print control apparatus according to the present invention causes a print head to print pixels constituting each image line during its primary scanning, said print head having columnarly arranged nozzles to eject different color inks according to printing data. While performing printing, the print control apparatus judges whether or not a prescribed printing condition holds for the image line to be printed. Then, the print control unit changes the number of nozzles (overlapping with each other) during the printing of each image line under the printing condition which has been established. In other words, each image line is printed such that the number of nozzles is changed depending on whether or not the printing condition has been established. The printing condition is not specifically restricted; it may be one which is based on the characteristic properties of the print pixels contained in each image line. Alternatively, it may be one which requires the number of nozzles to be changed in specific regions or which specifies specific pixel regions. The mode in which change is made is not specifically restricted; it may be 2-pattern (1 nozzle or 2 nozzles) or 3-pattern (1 nozzle, 2 nozzles, or 3 nozzles).

As explained above, the present invention makes it possible to change the number of nozzles adequately according to the printing condition for each image line at the time of printing.

The print control apparatus of the present invention may be constructed such that the print control unit (which changes the number of nozzles according to the printing condition) causes N nozzles to be used for the printing of an image line for which the printing condition is not established and also causes N+1 or more nozzles to be used for the printing of an image line for which the printing condition holds.

In this case, the print control unit causes N nozzles to be used for the printing of an image line for which the image line judging unit has judged that the printing condition does not hold. Also, the print control unit causes N+1 or more nozzles to be used for the printing of an image line for which the image line judging unit has judged that the printing condition holds. In this way it is possible to present one embodiment in which the number of nozzles is changed.

The printing condition is not specifically restricted as mentioned above. Therefore, it is possible to adopt an embodiment that permits the user to specify the printing condition to change the number of nozzles. In this case the user can conveniently change the number of nozzles at his discretion. Therefore, the print control apparatus of the present invention may be provided with a printing condition specifying unit which specifies the printing condition requiring a change to be made in the number of nozzles to be used for a specific image line.

In this case, the printing condition specifying unit can specify the printing condition (requiring a change to be made in the number of nozzles to be used) for a specific image line. Once the printing condition has been specified, the print control unit changes the number of nozzles to be used in the specific region which has been specified. In this way it is possible for the user to specify the image line for which the number of nozzles should be changed.

For the print control unit to judge whether or not the printing condition holds, the print control apparatus of the present invention may be constructed such that the image line judging unit judges whether or not the image line contains specific print pixels as the print condition.

In this case, the image line judging unit judges whether or not the image line contains specific print pixels as the print condition. In this way it is possible for the user to change the number of nozzles on the basis of print pixels.

Thus the print control apparatus of the present invention may be constructed such that the print control unit causes an image line to be printed with N+1 or more nozzles if the image line judging unit judges that the image line contains print pixels to be formed in a specific dot pattern.

In this case, the image line judging unit judges whether or not the image line contains print pixels to be formed in a specific dot pattern. If judge is so, the print control unit causes the image line to be printed with N+1 or more nozzles.

In this way it is possible to prevent banding by using more nozzles than usual for the printing of an image line which contains print pixels in a dot pattern which is subject to banding.

According to the present invention, the dot pattern in an image line to be printed with N+1 or more nozzles may be one which is formed with dots whose size is approximately equal to the resolution.

In this case, the image line judging unit judges that the print condition holds if an image line to be printed contains print dots formed with dots whose size is approximately equal to the resolution. Thus, the print control unit causes this image line to be printed with N+1 or more nozzles. In this way it is possible to show the dot pattern which is subject to banding.

Alternatively, the print control apparatus of the present invention may be constructed such that the print control unit causes an image line to be printed with N+1 or more nozzles if the image line judging unit judges that the image line contains print pixels to be formed with prescribed inks.

In this case, the image line judging unit judges whether or not the image line contains print pixels to be formed with prescribed inks. And, the print control unit causes the image line to be printed with N+1 or more nozzles if the image line judging unit judges that the image line contains such print pixels.

In this way it is possible to prevent banding by using more nozzles than usual for the printing of an image line which contains print pixels with ink colors which are subject to banding.

According to one embodiment of the present invention, the image line to be printed with N+1 or more nozzles should contain print pixels to be formed with a black ink.

In this case, the image line judging unit judges that the print condition holds if the image line to be printed contains print pixels formed with a black ink. And, the print control unit causes the image line to be printed with N+1 or more nozzles. In this way it is possible to show the ink color which is subject to banding.

In order that an image line is printed effectively with N+1 or more nozzles, the print control apparatus of the present invention may be constructed such that the print control unit causes an image line to be printed with N+1 or more nozzles if the image line is recorded with specific dot species in a ratio higher than specified.

In this case, the print control unit causes the image line to be printed with N+1 or more nozzles if the image line judging unit judges that the image line is recorded with specific dot species in a ratio higher than specified.

In this way it is possible to effectively prevent banding with more nozzles than usual.

In performing printing in prescribed band units, there arises a need to store the image line for which the printing condition holds. Consequently, the print control apparatus of the present invention may have a region storage unit to store the region of the image line for which the printing condition holds.

In this case, the region storage unit stores the image line for which the printing condition holds. In this way it is possible to perform printing in prescribed band units even in the case where the number of nozzles is changed.

In the case where the number of nozzles to be used for printing is changed for each image line, there occurs an instance where nozzles overlap when the mode of print head feeding is changed in accordance with this change. Once nozzles overlap, an image line which has been printed undergoes printing again with other nozzles. Therefore, the print control apparatus of the present invention may be constructed such that the above-mentioned print control unit is provided with the image line print storage unit which stores the image line which has been printed, and the nozzles facing the image line stored in the image line print storage unit are made inoperable (non-eject) at the time of printing.

In this case, the print control unit is provided with the image line print storage unit which stores the image line which has been printed. And, this print control unit make inoperable the nozzles facing the image line stored in the image line print storage unit at the time of printing. In this way it is possible to prevent the overlapping of ink discharge.

On the other hand, it is not necessary to store the completion of printing each time, depending on how the printing condition of the image line is established. Therefore, it is acceptable that storage is made only in the extent to which the completion of printing is required. Thus, the print control apparatus of the present invention may be constructed such that the above-mentioned image line print storage unit has the print finish monitor region which monitors whether or not printing around the image line including the above-mentioned printing pixel has been completed and this print finish monitor region stores the above-mentioned image line.

In this case, the image line print storage unit establishes the print finish monitor region which monitors whether or not printing around the image line including the printing pixel has been completed and the image line print storage unit causes this print finish monitor region to store the above-mentioned image line.

In this way, it is possible to speed up the printing process by establishing the monitor region and executing print monitoring only for the region to be monitored.

The print control apparatus of the present invention may be constructed such that the above-mentioned print finish monitor region is established sufficiently above the image line including the above-mentioned print pixel.

In this case, the print finish monitor region is established sufficiently above the image line including the print pixel for which the printing condition is established.

In this way it is possible to establish the print finish monitor region and exhibit the effective range.

The print control apparatus of the present invention may be constructed such that the above-mentioned print finish monitor region corresponds to the number of nozzles arranged in the above-mentioned nozzle column. This is the typical range to be adopted by the print finish monitor region.

In this case, the print finish monitor region is so established as to correspond to the number of nozzles arranged in the nozzle column.

In this way it is possible to specify the extent in which the print finish monitor region is established.

In the case where the technique to monitor the completion of printing is not employed as mentioned above, it is desirable to print individually the region where the printing condition holds and the region where the printing condition does not hold. Therefore, the print control apparatus of the present invention may be constructed such that the above-mentioned print control unit executes printing in the other image region after it has completed printing for either of the image region formed by the image line containing the above-mentioned print pixel or the image region formed by the other image line.

In this case, the print control unit performs printing for the other image region after completion of printing on either of the image region formed by the image line containing the print image for which the printing condition is established or the image region formed by the other image line.

In this way it is possible to print individually the regions in which the number of nozzles is switched.

There will be an instance where return occurs in the print heat if printing is completed for each region. So, the print control apparatus of the present invention may be constructed such that in the case where return occurs in the above-mentioned nozzle column when printing is performed on the other image region after completing printing for either the image region formed by the image line containing the above-mentioned print pixel or the image region formed by the other image line, the above-mentioned print control unit keeps the above-mentioned print data when scanning is carried out to the state in which no return of the nozzle column occurs and causes the image line to be printed according to the same printing data while rearranging the order of primary scanning so that no return of the nozzle column occurs.

In this case, printing for the other image region is executed by the print control unit after printing has been completed for either of the image region formed by the image line containing the image pixel or the image region formed by the other image line. If return of the nozzle column occurs under this situation, the print control unit keeps printing data while primary scanning is performed to such an extent that no return of the nozzle column occurs and then rearranges the sequence of primary scanning so that no return of the nozzle column occurs and causes the image line to be printed according to the rearranged print data.

In this way it is possible to prevent the return of the nozzle column.

In addition, the technique of printing each pixel of the image line by causing ink to be ejected from the nozzle column while scanning the print head having the nozzle column to eject individual color inks based on the printing data is not necessarily restricted to a tangible entity. It is easily understood that it functions also as its method.

In other words, it is not necessarily restricted to a tangible entity but it is also effective as a method.

In the meantime, such a print control apparatus may exist alone or may be utilized in the form incorporated into a certain apparatus. The concept of the present invention is not restricted to it; however, it includes a variety of embodiments. Therefore, it may take on a form of software or hardware according to circumstances. In the case where the idea of the present invention is embodied in the form of software of the print control apparatus, the present invention covers a recording medium storing such software as a matter of course.

Needless to say, such a recording medium may be a magnetic recording medium or a magneto-optical recording medium or any recording medium which will be developed in the future. The software may be in the form of primary copy or secondary copy. Moreover, the idea of the present invention will be embodied in the form of partly hardware and-partly software. Another possible form is such that a part of software is stored in a recording medium and read in according to need.

BRIEF DESCRIPTION OF THE DRAWINGS

FIG. 11 is a diagram showing how printing is performed in the normal mode.

FIG. 12 is a diagram showing how printing is performed in the normal mode and overlap mode.

FIG. 14 is a diagram showing how printing is performed between the first pass to the ninth pass.

DESCRIPTION OF THE PREFERRED EMBODIMENTS

The embodiments of the present invention will be described below in the following order.

Figure 1:
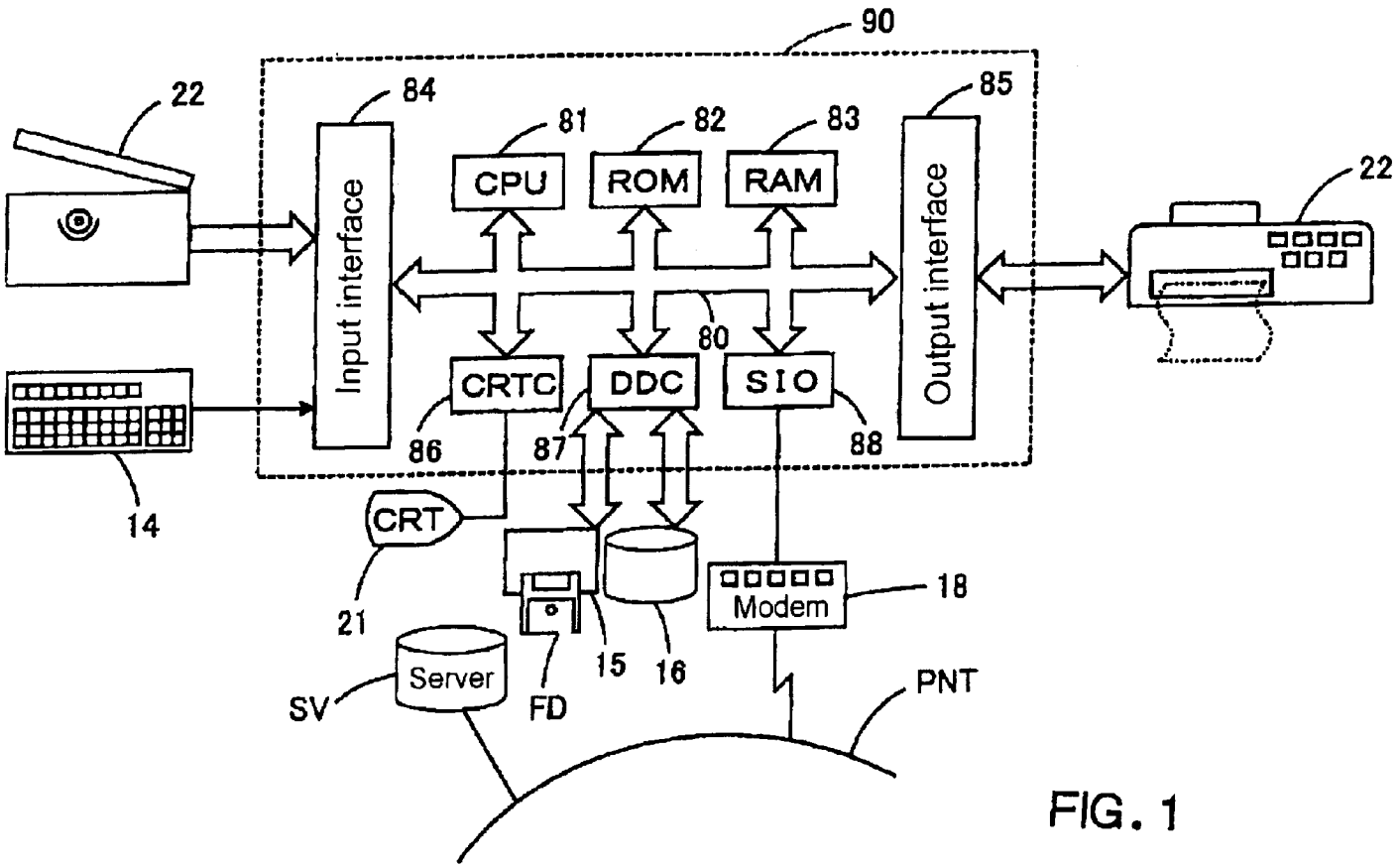
FIG. 1 is a diagram showing the construction of the printing apparatus in which the print control apparatus of the present invention is embodied.

(1) Construction of the apparatus (2) Print control process (3) Image judging process and rasterizing process (4) Processing involving the print monitor mode (5) Processing not involving the print monitor mode (6) Summary (1) Construction of the Apparatus The print control apparatus of the present invention is embodied in a printing apparatus as shown in FIG. 1. In this figure, there is shown a computer 90 to which are connected a scanner 12 and a color printer 22. With a prescribed program loaded and executed, this computer 90, in conjunction with the printer 22, functions as a printer. This computer 90 is provided with a CPU 81, a ROM 82, RAM 83, and other components listed below, which are connected to one another through a bus 80.

Input interface 84 to manage the input of signals from the scanner 12 and the keyboard 14.

Output interface 85 to manage the output of data to the printer 22.

CRTC 86 to control signal output to a CRT 21 capable of color display.

Disc controller (DDC) 87 to control data transfer to and from a hard disc 16, a flexible drive 15, or a CD-ROM drive (not shown).

Hard disc 16 to store various programs (including those in the form of device driver) which are to be loaded to the RAM 83 for execution.

In addition, connected to the bus 80 is a serial input/output interface (SIO), which is connected to a modem 18 for further connection to the public telephone network (PNT).

The computer 90 is connected to the external network through the SIO 88 and the modem 18. Upon connection to a specific server SV, it downloads to the hard disc 16 any program necessary for image processing. Moreover, the computer 90 executes any program which is loaded from the flexible disc FD or CD-ROM.

Figure 2:
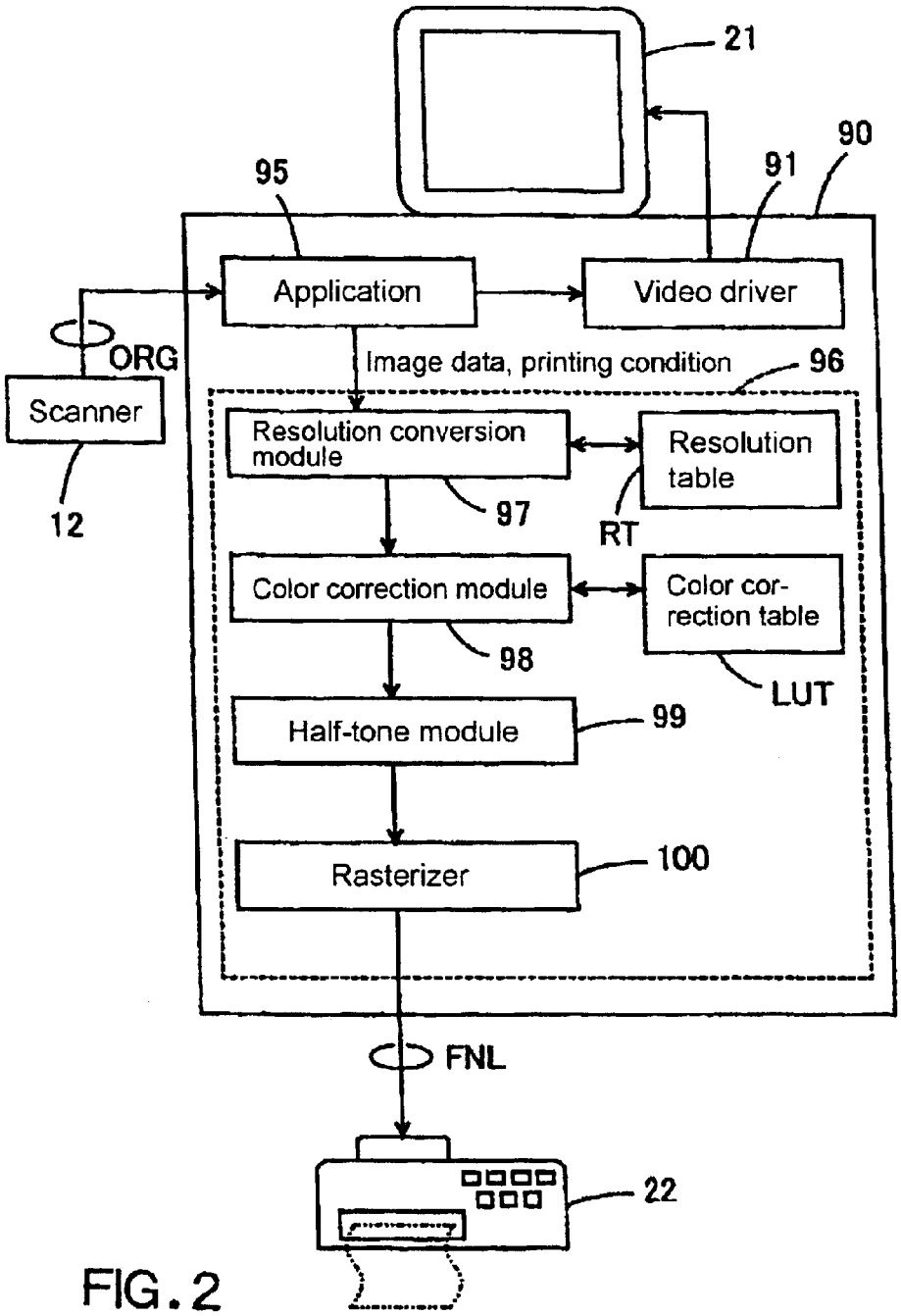
FIG. 2 is a diagram showing the construction of the software for the printing apparatus.

The software used by the printing apparatus is constructed as shown in FIG. 2. In this figure, there is shown a computer 90, in which an application program 95 works under the control of a prescribed operating system. Into the operating system are incorporated a video driver 91 and a printer driver 96. These drivers permit the application program 95 to output print data (FEL) to the printer 22. The application program 95 for image retouching reads an image from the scanner 12, performs prescribed processing on it, and displays the processed image on the CRT 21 through the video driver 91. The data (ORG) of a color original which is supplied from the scanner 12 is composed of three colors (red R, green G, and blue B) each having a gradation value.

When this application program 95 issues a command for printing, the printer driver 96 of the computer 90 receives the image data and printing condition from the application program 95 and converts them into signals capable of being processed by the printer 22. One of the printing conditions entered is the kind of printing medium. In the example shown in FIG. 2, the printer driver 96 has a resolution conversion module 97, a resolution table RT, a color correction module 98, a color correction table LUT, a half-tone module 99, and a rasterizer 100.

The resolution conversion module 97 performs conversion into the resolution of color image data handled by the application program 95 (or converts the number of pixels per unit length into the resolution meeting the printing condition). The resolution table RT stores the resolution meeting the printing condition. The resolution conversion module 97 references the resolution table RT, thereby establishing the resolution meeting the printing condition and performing conversion into the resolution. The image data which has undergone resolution conversion in this way is still in the form of image information consisting of three colors (RGB).

The color correction module 98 references the color correction table LUT, thereby converting for each pixel the color component of the image data from RGB into cyan (C), magenta (M), yellow (Y), and black (K) to be used by the printer 22. This color correction is not carried out if the printing condition specifies that no color printing should be performed. Once this color correction has been performed, the resulting data has as wide a gradation value as 256. The half-tone module 99 allows the printer 22 to express the gradation value (or half-tone) with scattered dots.

The printer 22 according to this embodiment ejects ink in varied quantities (as mentioned later), thereby forming dots varying in area. (In other words, it is a gray-scale printer.) The half-tone module 99 judges whether dots should be made or not for each pixel according to the gradation value of the image data. The thus processed image data is rearranged by the rasterizer 100 in the order for transfer to the printer, and the rearranged data is finally output as the print data FNL. In this embodiment, the printer 22 forms dots according to the print data FNL but does not perform image processing; however, provisions may be made so that the printer 22 performs such processing.

Figure 3:
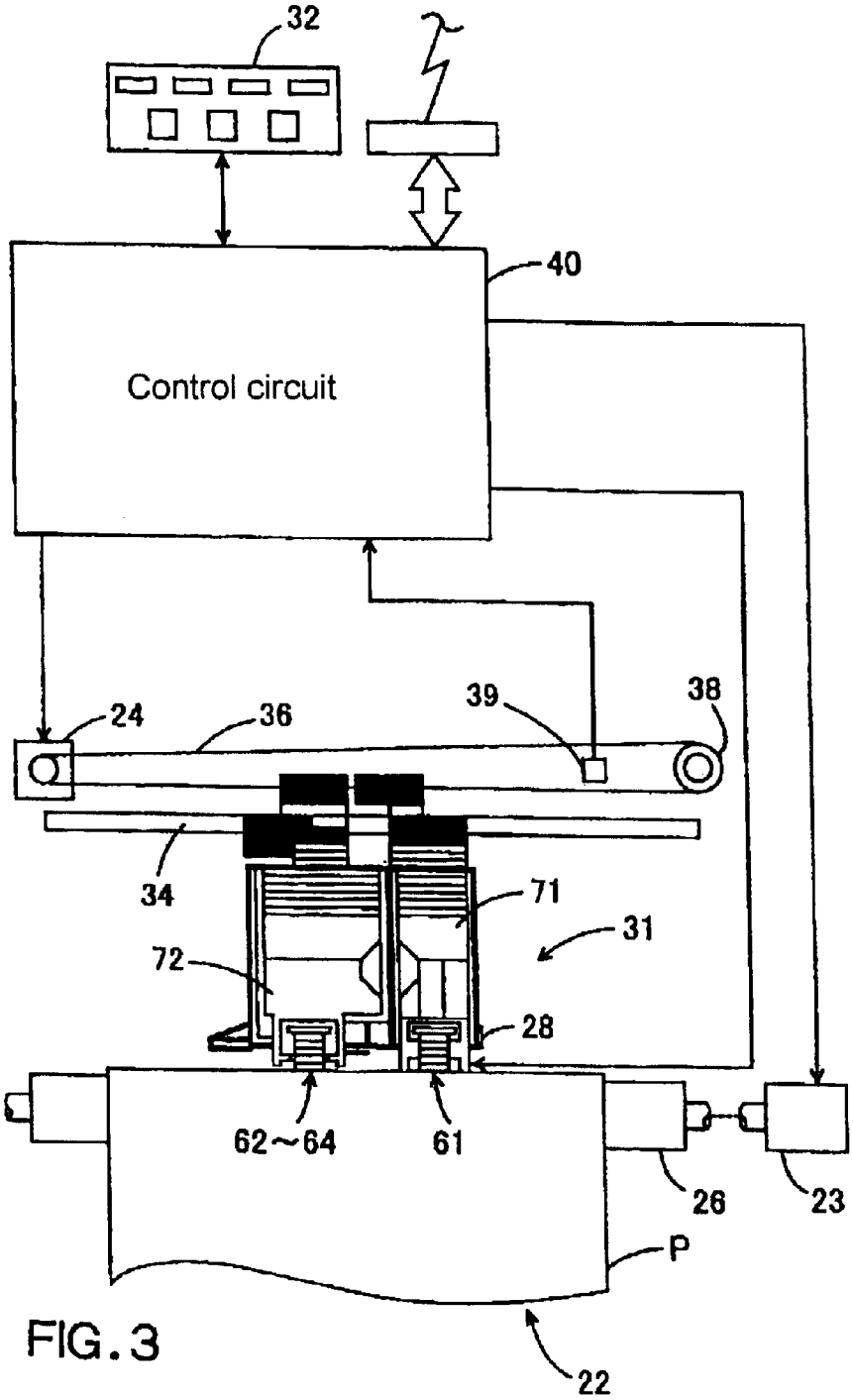
FIG. 3 is a schematic diagram showing the construction of the printer.

The printer 22 is constructed as schematically shown in FIG. 3. The printer 22 has a mechanism to feed paper (P) by means of a paper feed motor 23, a mechanism to move the carriage 31 back and forth (in the axial direction of the platen 26) by means of the carriage motor 24, a mechanism to drive the print head 28 (mounted on the carriage 31), thereby causing ink to be ejected to form dots, and a control circuit 40 to manage exchange of signals to and from the paper feed motor 23, the carriage motor 24, the print head 28, and the control panel 32.

The mechanism to move the carriage 31 back and forth in the axial direction of the platen 26 consists of a sliding shaft 34 to slidably hold the carriage 31 mounted parallel to the axis of the platen 26, a pulley to stretch an endless belt 36 from the carriage motor 24, and a sensor 39 to detect the home position of the carriage 31.

Incidentally, this carriage 31 can mount the ink cartridge 71 holding black ink (Bk) and the ink cartridge 72 holding three color inks—cyan (C), magenta (M), and yellow (Y). The print head 28 (under the carriage 31) has four ink ejecting heads 61 to 64. When the carriage 31 is loaded from above with the cartridge 71 (for black (Bk) ink) and the cartridge 72 (for color inks), each ink cartridge is ready to supply ink to the ink ejecting heads 61 to 64.

The following description is concerned with the mechanism to eject ink and to form dots.

Figure 4A:
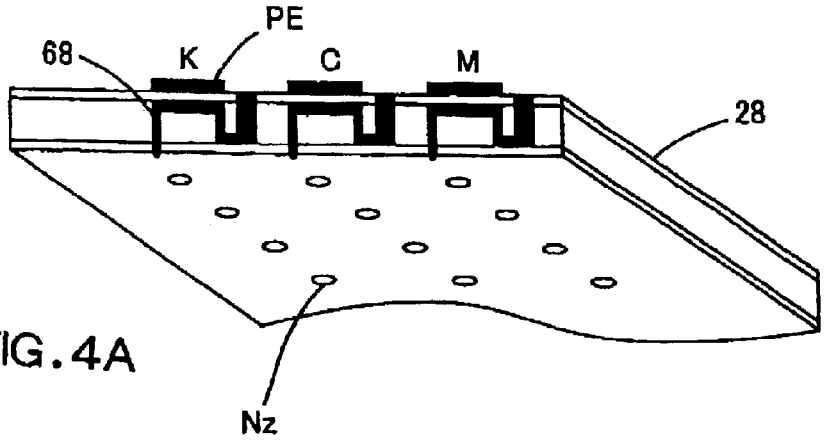
FIGS. 4(*a*) and 4(*b*) are schematic diagrams showing the internal structure of the ink ejecting head.

The inside of the ink ejecting head 28 is constructed as schematically shown in FIG. 4. (The head for yellow ink is omitted.) Each of the heads 61 to 64 is provided with a piezoelectric element and seven ink jet nozzles Nz. As shown in FIG. 4A, the piezoelectric element PE is placed at the position in contact with the ink passage 68 which introduces ink to the ink jet nozzle Nz. As known well, the piezoelectric element PE performs electrical-mechanical energy conversion extremely rapidly as its crystalline structure deforms upon voltage application.

Figure 4B:
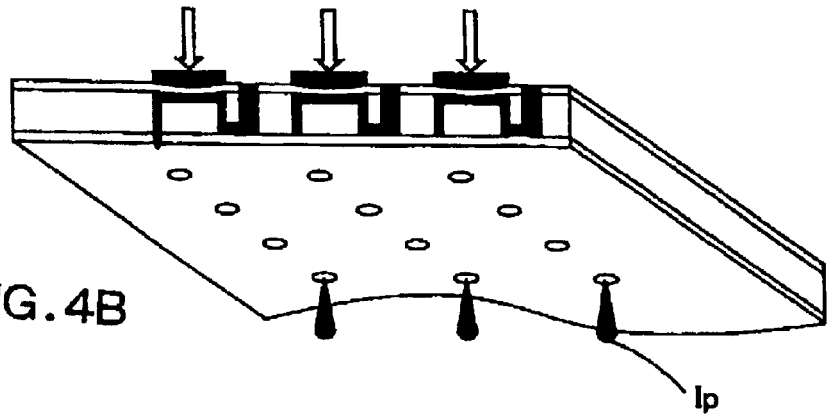

In this embodiment, the piezoelectric element PE has voltage applied across the electrodes at its ends at prescribed time intervals. As shown in FIG. 4B, the piezoelectric element PE stretches while voltage is being applied, thereby deforming the one side of the walls of the ink passage 68. As the result, the volume of the ink passage 68 contracts as the piezoelectric element PE stretches. As much ink as corresponding to this contraction is rapidly ejected (in the form of droplets Ip) from the tip of the ink jet nozzle Nz. The ink droplets Ip penetrate the paper P mounted on the platen 26. In this way, printing is accomplished.

Figure 5:
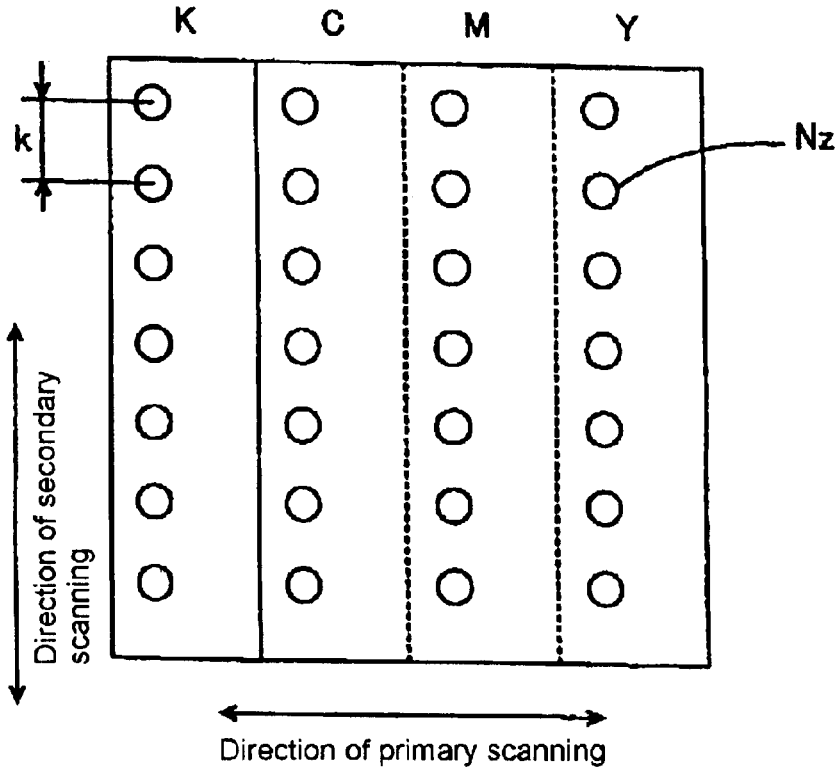
FIG. 5 is a diagram showing the arrangement of ink jet nozzles in the ink ejecting head.

Each of the ink ejecting heads 61 to 64 has ink jet nozzles Nz arranged as shown in FIG. 5. The nozzle arrangement is composed of four sets of nozzle array, each ejecting respective color inks. Seven ink jet nozzles Nz are arranged at a certain nozzle pitch k. The positions of the nozzle arrays coincide with one another in the direction of secondary scanning. Arrangement in this manner makes it possible to reduce the nozzle pitch k in the manufacturing process.

Figure 6:
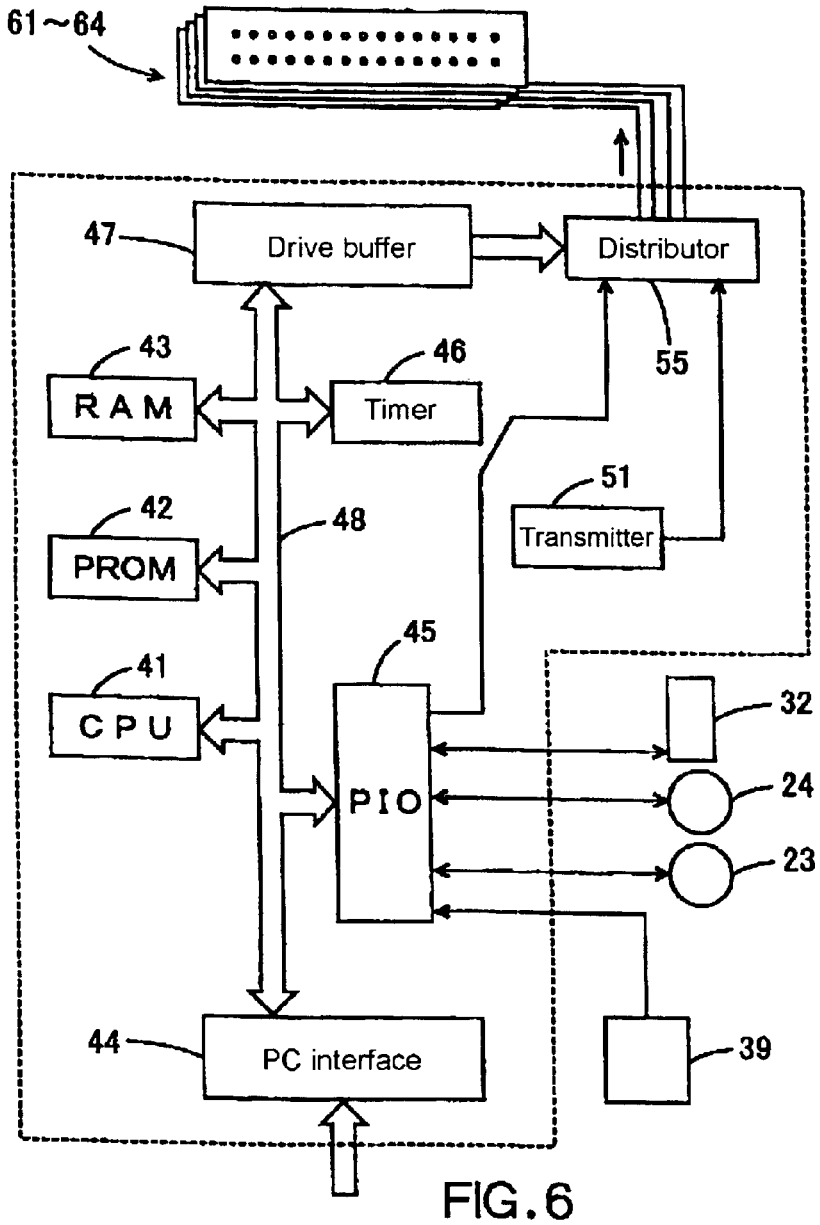
FIG. 6 is a diagram showing the internal structure of the control circuit 40.

The control circuit 40 of the printer 22 is constructed as shown in FIG. 6. The control circuit 40 consists of a CPU 81, a PROM 42, a RAM 43, a PC interface 44 (for data exchange with the computer 90), a paper feed motor 23, a carriage motor 24, a peripheral I/O 45 (for signal exchange with the control panel 32), a timer 46, and a drive buffer 47 (for on-off signals to be sent to the heads 61 to 64). These elements and circuits are connected to each other through a bus 48. In addition, the control circuit 40 is provided with a transmitter 51 to send out driving waves at a prescribed frequency, and a distributor 55 to distribute the output from the transmitter 51 to the heads 61 to 64 at prescribed timing.

The control circuit 40 receives the print data FNL which has been processed by the computer 90, stores it in the RAM 43 temporarily, and outputs it to the driving buffer 47 at prescribed timing. The driving buffer 47 determines on/off of the driving waveform W1, W2, and W3 for each pixel according to the printing data FNL, and it outputs the result to the distributor 55.

As shown in FIG. 5, the heads 61 to 64 are arranged in the direction in which the carriage 31 moves. Therefore, there is a difference in timing for each nozzle column to reach the same position with respect to paper P. The distributor 55 is provided with a delay circuit at its output side (although not shown). Therefore, the driving waveform is output for such timing that dots formed by each nozzle coincide in the primary scanning direction in response to the displacement of position of each nozzle of the heads 61 to 64 and the speed of the carriage 31. The CPU 41 outputs (through the driving buffer 47) signals for on/off of dots at proper timing in consideration of the displacement of position of each nozzle of the heads 61 to 64. In this way, dots of each color are formed. The output of on/off signals is performed in the same way for two nozzle columns formed in each of the heads 61 to 64.

The printer 22 constructed as mentioned above causes the carriage 31 to move back and forth by means of the carriage motor 24 while feeding paper P by means of the paper feed motor 23, and at the same time it drives the piezoelectric element PE of each of the color heads 61 to 64 of the print head 28, thereby ejecting each color ink and forming a multi-color image with dots on the paper P. (The carriage movement is referred to as primary scanning, and the paper feed is referred to as secondary scanning.)

Incidentally, in this embodiment, the printer 22 is provided with a head which ejects ink by means of the piezoelectric element PE as mentioned above. However, the printer may be provided with a means to eject ink by any other method. Such a means includes one which ejects ink by means of bubbles generated in the ink passage by energizing a heater placed in the ink passage.

(2) Print Control Process

Figure 7:
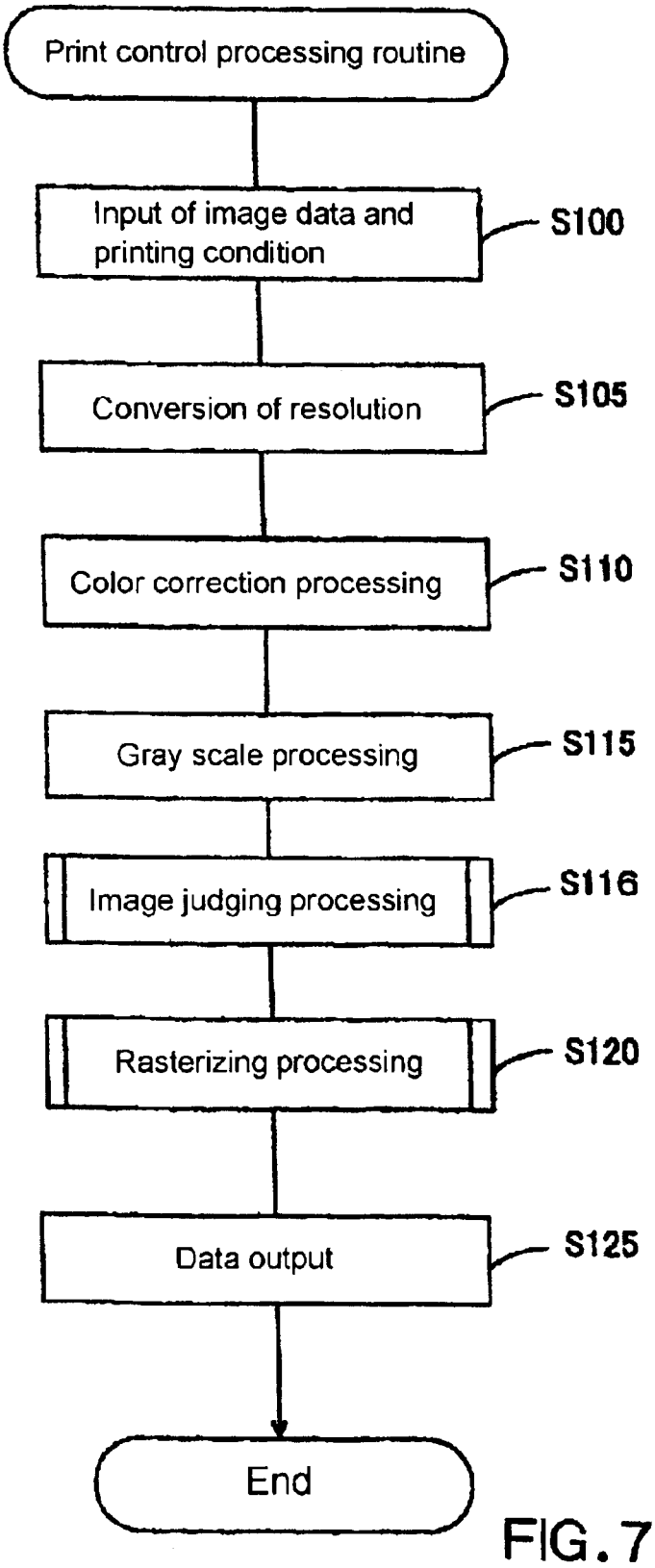
FIG. 7 is a flowchart showing what is done by the print control process.

The computer 90 outputs print data FNL to the printer 22 according to the print control process which is carried out as illustrated by the flowchart in FIG. 7. To start the print control process, the CPU 81 enters the image data and printing condition (step S100). This image data is the one which has been transferred from the application program 95 shown in FIG. 2. It has the gradation values in 256 steps (0 to 255) for each color (R, G, B) of pixels constituting the image. The resolution of the image data varies depending on the resolution of the data ORG of the original image. The printing condition includes the kind of printing paper and whether or not to perform color printing.

Then, the CPU 81 converts the resolution of the entered image data into the resolution suitable for printing by the printer 22. (step S105) Next, the CPU 81 performs the color correction process for each pixel. (step S110) The color correction process is a process to convert the image data consisting of gradation values of R, G, B into the data of gradation values for each color of C, M, Y, K. This process is accomplished by using the color correction table LUT which previously stores the combination of C, M, Y, K required by the printer 22 to express colors composed of the combination of R, G, B. Any known technique may be employed for the color correction process that uses the color correction table LUT. For example, the process by interpolation may be employed.

As the result of this process, the image data is converted into data having 256 gradations for each color of C, M, Y, K. The CPU 81 performs the gray scale process on the color-corrected image data. (step S115) The gray scale process is a process to convert the gradations (256 gradations in this embodiment) of the original pixel data into the gradation values which the printer 22 can express for each pixel. In this embodiment, the gray scale process is accomplished by so-called error diffusion method.

Subsequently, the CPU 81 performs the image judging process mentioned later. (step S116) This image judging process is followed by the rasterizing process. (step S120) The rasterizing process is a process to rearrange the data for one image line in the order for transfer to the head of the printer 22. There are several printing modes in which the printer 22 forms image lines. The simplest one is normal mode, in which all the dots constituting each image line are formed by one reciprocal movement of the head. In this case, all that is required is to output the data for one image line sequentially in the processed order. The other mode is so-called overlap mode. In the overlap mode, every other dots for each image line are formed in the first primary scanning and the remaining dots are formed in the second primary scanning.

In this case each image line is formed by performing the primary scanning twice. This printing method requires that the data representing every other dots for each image line be transferred to the head. The printing data FNL to be transferred to the head according to the printing method employed by the printer is generated in this way. Once the printing data FNL suitable for printing by the printer 22 has been generated, the CPU 81 transfers this printing data FNL to the printer for each pixel. After the processing that follows step S110 has been completed for all pixels, the print control processing is completed. (step S125) The printer 22 receives the printing data FNL transferred for each pixel and forms dots for each pixel, thereby performing image printing.

In this embodiment, when the data for image line is generated by executing the rasterizing process in step S120, mode is switched between the normal mode and the overlap mode for each image line according to circumstances. At this time, the printing condition is entered which specifies the normal mode or the overlap mode to be established for each image line in the image judging processing in step S116. Such printing condition is judged on the basis of characteristic properties possessed by the image line. In this embodiment, an image line is judged to be a specific image line if it contains printing pixels formed with black ink, and the printing condition for overlap mode is specified for this specific image line. This is because banding is liable to occur in the region where printing with black ink is performed.

The result of printing in overlap mode only those image lines formed with black ink (or the result of performing printing in overlap mode for a specific image line while performing high-speed printing in normal mode for other image lines) is that it is possible to prevent banding and to produce high-quality prints rapidly.

As mentioned above, this embodiment is constructed such that when the printing condition is specified, the overlap mode is applied to the image lines with black ink which are subject to banding. Needless to say, this is not the only factor which limits the printing condition to switch between the image line to be printed in normal mode and the image line to be printed in overlap mode. It is permissible to employ the overlap mode for image lines with other color inks, and it is also permissible to switch between the normal mode and the overlap mode according to the dot shape rather than ink color. In this case, a better effect is produced from the standpoint of preventing banding if the overlap mode is applied to image lines with dots approximately equal to the resolution.

(3) Image Judging Process and Rasterizing Process

Figure 8:
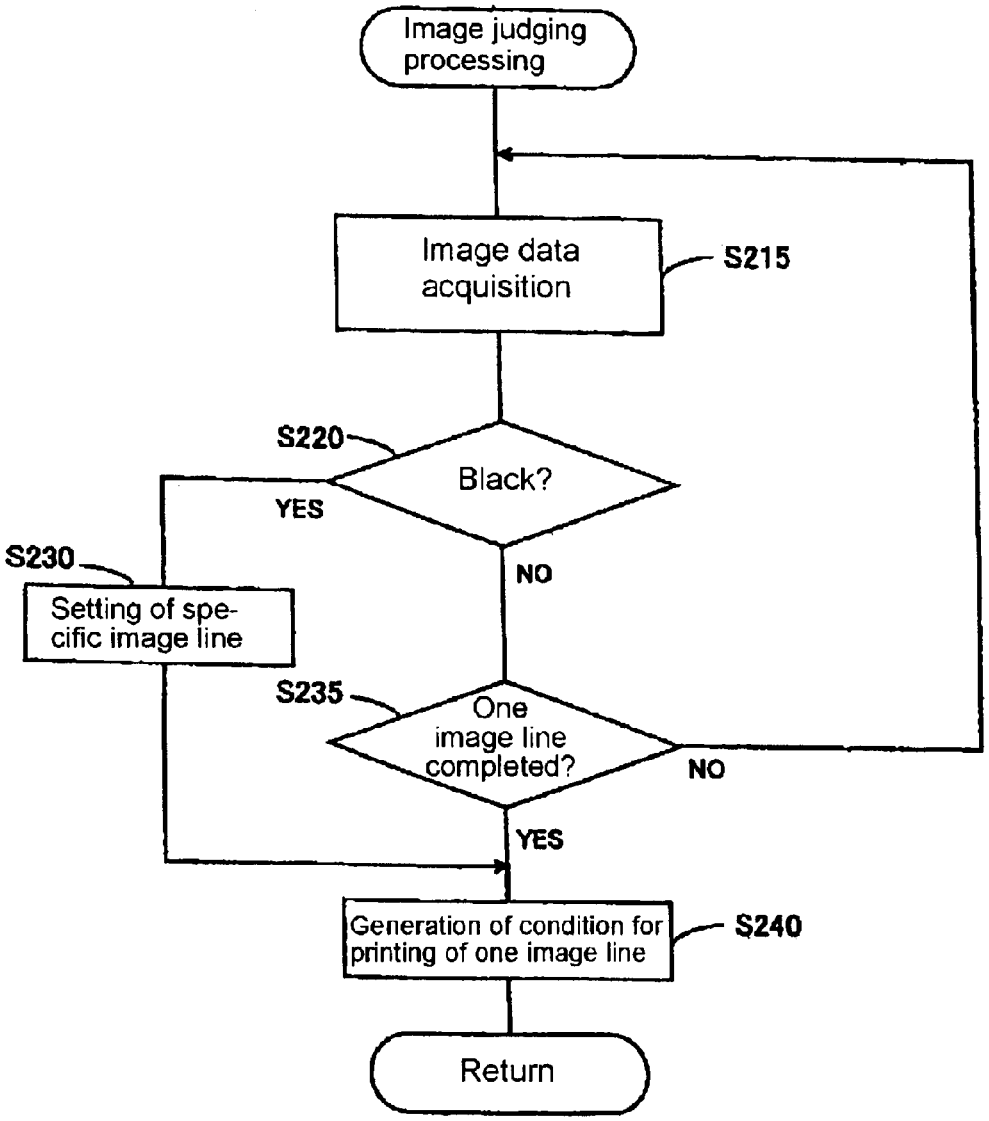
FIG. 8 is a flowchart showing what is done by the image judging process.
Figure 9:
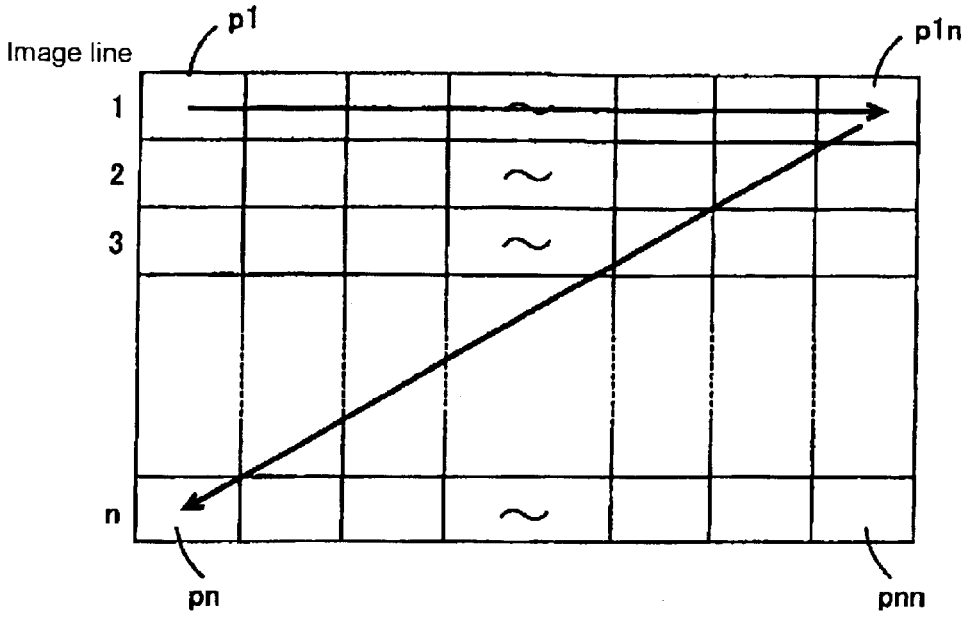
FIG. 9 is a diagram showing the construction of image data.

The image judging process proceeds according to the flowchart shown in FIG. 8. The first step is to acquire the pixel data sequentially (beginning from the top pixel p1 to the last pixel pin of the image line 1) for the band width (the unit for printing) formed by the image lines 1 to n shown in FIG. 9. (step S215) The second step is to judge whether or not the pixel data is the one for black ink. (step S220) If the procedure judges that the pixel data is the one for black ink, it establishes this image line 1 as the specific image line. (step S230) On the other hand, if the procedure does not judge that the pixel data is the one for black ink, the procedure judges whether or not all the pixels (pixels p1 to p1*n*) of the image line 1 have been completed and moves to the acquisition of pixel data for one image line sequentially. (step S235) When judgment for one image line is complete, the procedure generates the printing condition for one image line that specifies the specific image line to the overlap mode and specifies the other lines to the normal mode. (step S240)

Figure 10:
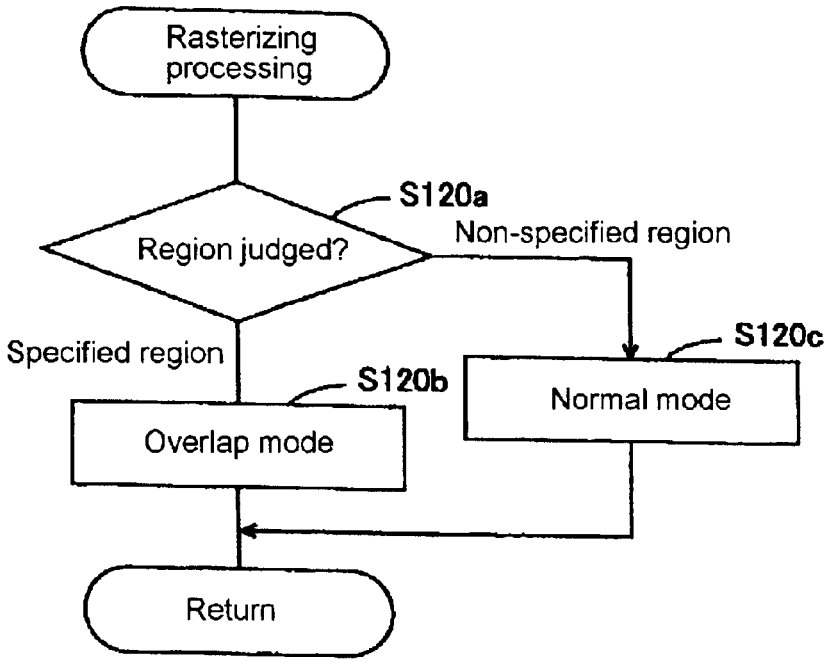
FIG. 10 is a flowchart showing what is done by the rasterizing process.

Then, in the rasterizing process in step S120 shown in FIG. 10, at the time of rasterizing, whether or not the image line to be rasterized is the specific region constituted by the specific image line or the non-specific image region not constituted by the specific image line is judged. (step S120*a*) If judged to be the specific region, rasterizing is performed on the basis of overlap mode, and if judged to be the non-specific region, rasterizing is performed on the basis of normal mode. (step S120*c*)

(4) Processing Involving the Print Monitor Mode

A mention is made below of one embodiment in which the above-mentioned print control processing is executed. In this embodiment, the nozzle and image position in the normal mode is shown in FIG. 11. (In the normal mode, one image line is printed by a single primary scanning assuming that the nozzle resolution is half the print resolution and the number of ink jet nozzles (Nz) is 7.) Likewise, the nozzle and image position in the full overlap mode is shown in FIG. 12. (In the full overlap mode, one image line is printed by the primary scanning repeated twice.) In FIG. 11, it is assumed that one paper feed corresponds to seven lines and the first line of image is at the fourth nozzle of the first pass. Any line after that may be regarded as the first line. In this printing method, the seventh nozzle is not used. (The nozzle which is not used is referred to as a dummy nozzle hereinafter.) After the image line 1, a specific region constructed of specific image lines is formed. Therefore, the transfer from the normal mode to the overlap mode is realized by printing the first line of the image line 1 at the position shown in FIG. 12. Here, "pass" denotes the number of cycles of primary scanning, and the first pass denotes the first cycle of primary scanning.

Here, there is an instance where the pass to transfer to the overlap mode cannot print the image line 1 as in the case of the second pass in FIG. 12. In this instance, the image line 2 is made the first line of the specific region. In FIG. 12, in the case where the printing mode has moved to the overlap mode after the first pass, there is a possibility that the image lines above the image line 1 was printed while the printing mode was in the normal mode. Therefore, it is necessary to judge whether or not the first to third nozzles should be made "non-eject". There is an instance where the image line 2 should mate with the first line in the specific region. Consequently, the six image lines in the specific region becomes the region which needs judgment about the presence or absence of printing.

In this embodiment, the case in which judgment is made about the presence or absence of printing is called the print monitor mode, and the region which needs movement to the print monitor mode is called the monitor region.

Figure 13:
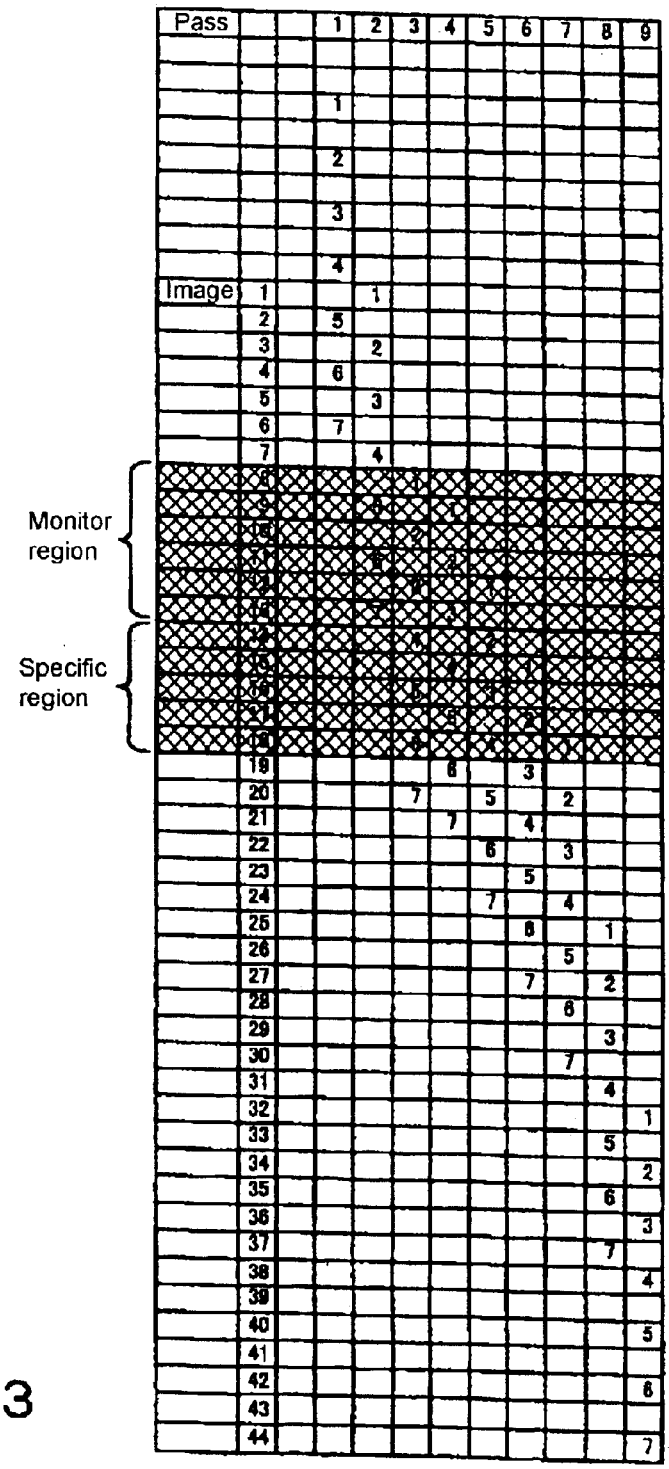
FIG. 13 is a diagram showing how printing is performed in the print monitor mode.

FIG. 13 shows the method of printing the specific region in the overlap mode and other regions in the normal mode. In this figure, the image lines 14–18 belong to the specific region to be printed in the overlap mode, and other image lines 1–13 and the image lines 19–44 belong to the region to be printed in the normal mode. And, the image lines 8–13 belong to the monitor region. The following description is given for each pass.

First pass: Printing is accomplished in the normal mode because the specific region (indicated by dark gray) does not extend over the space between the first nozzle and the seventh nozzle (this space is called the band region hereinafter). Being printing in the normal mode, the amount of paper feed is 7 lines. In addition, since the band region does not extend to the monitor region (light gray), the print monitor to judge the presence or absence of printing is not executed.

Second pass: Printing is accomplished in the normal mode because the specific region does not extend to the band region. Also, the amount of paper feed is seven lines as in the case above. On the other hand, since the band region extends to the monitor region in the second pass, the print monitor mode is started, and the image lines which have been printed are recorded as the monitor data.

Third pass: Printing is performed on only odd-numbered pixels by the fourth to sixth nozzles used to print this specific region because the specific region is present in the band region. Here, according to FIG. 12, in order to complete the printing of the first line in the specific region or to complete the printing of the image line 14, all that is required is to perform printing such that the lines under the third nozzle in the subsequent fourth pass (the second pass in FIG. 12) becomes the first line in the specific region. Therefore, the amount of paper feed is one line.

Fourth pass: Since the image lines 9, 11, 13 facing the first to third nozzles have been printed in the second pass and recorded as the monitor data, printing is not executed. (In actual, at the time of rasterizing, it generates the printing data making "non-eject" to prevent printing.) Only the even-numbered pixels are printed by the fourth and fifth nozzles. On the other hand, the sixth and seventh nozzles print all the pixels, and the fact that printing has been accomplished is recorded as the monitor data. The amount of paper feed is three lines on account of the overlap mode, as in FIG. 12. After this, the amount of paper feed is three lines so long as the specific region partly overlaps the band region.

Fifth pass: As the image line 12 facing the first nozzle has been printed in the third pass and it has been recorded as the monitor data, it is made "non-eject". And the second to fourth nozzles print only the odd-numbered pixels. On the other, as the fifth nozzle has been recorded by the monitor data, it is made "non-eject". And, the sixth and seventh nozzles print all pixels. The amount of paper feed is three lines on account of the overlap mode.

Sixth pass: The first and second nozzles print only the even-numbered pixels. And, the fourth nozzle is made "non-eject" and the fifth to seventh nozzles print all pixels. The amount of paper feed is three lines because the sixth pass is also the overlap mode.

Seventh pass: As the image line 18 facing the first nozzle has been printed twice in the third pass and fifth pass, the first nozzle is made "non-eject". Likewise, the second to fourth nozzles are also made "non-eject". On the other hand, the fifth to seventh nozzles print all pixels. The amount of paper feed in the seventh pass is seven lines because the band region does not overlap the specific region. After this, the amount of paper feed is seven lines so long as the printing other than the specific region continues.

Eighth pass: The first to second nozzles are made "non-eject" on the basis of monitor data, and other nozzles print all pixels. Also, since the monitor data becomes empty in this eighth pass, the print monitor is completed. After the ninth pass, printing is repeated in the normal mode in the same way shown in FIG. 11. The printing mode from the first to ninth passes are as shown in FIG. 14.

Figure 15:
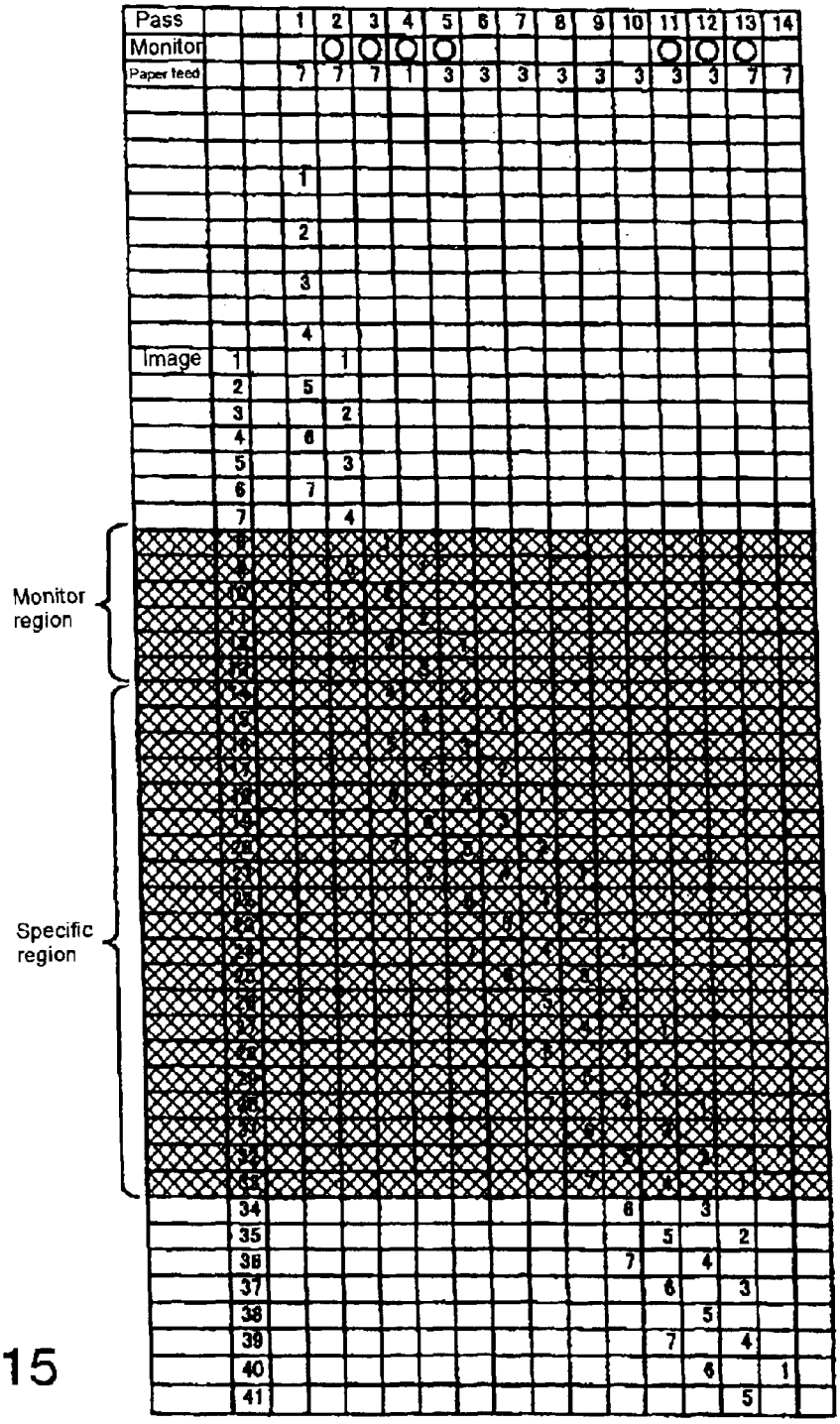
FIG. 15 is a diagram showing one mode of printing in which it is not necessary to move to the print monitor mode in a specific region.

In the embodiments shown in FIGS. 11 to 13, movement from the normal mode to the overlap mode and return from the overlap mode to the normal mode take place simultaneously in the band region. On the other hand, in the case where the specific region is formed more than a certain extent, there is a region which does not need the monitor region during movement from the overlap mode to the normal mode as shown in FIG. 15. In other words, there is no need to move to the print monitor mode between the sixth pass and the tenth pass. Here, the sixth nozzle in the third pass becomes the dummy nozzle in correspondence with FIG. 12. And, since the seventh nozzle does not exist in FIG. 12, it becomes the non-eject nozzle.

The algorithm for the above-mentioned processing is summarized as follows.

(a) If the specific region does not overlap with the band region, printing is performed in the normal mode (in which the amount of paper feed is 7 lines and all pixels are printed).

(b) If the specific region overlaps with the band region, printing is performed in the overlap mode (in which the amount of paper feed is 3 lines and the print ratio is 1/2). The first pass after switching from the normal mode to the overlap mode is such that the first line in the specific region coincides with the first line in FIG. 12.

The algorithm for the above-mentioned print monitor mode is summarized as follows.

(a) In the case where the normal mode has been switched over to the overlap mode, as soon as the band region enters the monitor region, the mode is switched over to the print monitor mode to start monitoring. After the band region has left the monitor region, the print monitor mode is finished and the recording of monitor data for the image line is suspended.

(b) In the case where the normal mode has been restored from the overlap mode, as soon as the band region begins to leave the specific region, the mode is switched over to the print monitor mode to start monitoring, and each time paper feed is performed, the band region is added to the monitor region. And, when the band region does not overlap with the specific region any longer, the adding of the monitor region is completed. When the buffer of the monitor data becomes empty, the print monitor mode is finished and the recording of monitor data for the image line is suspended.

Figure 16:
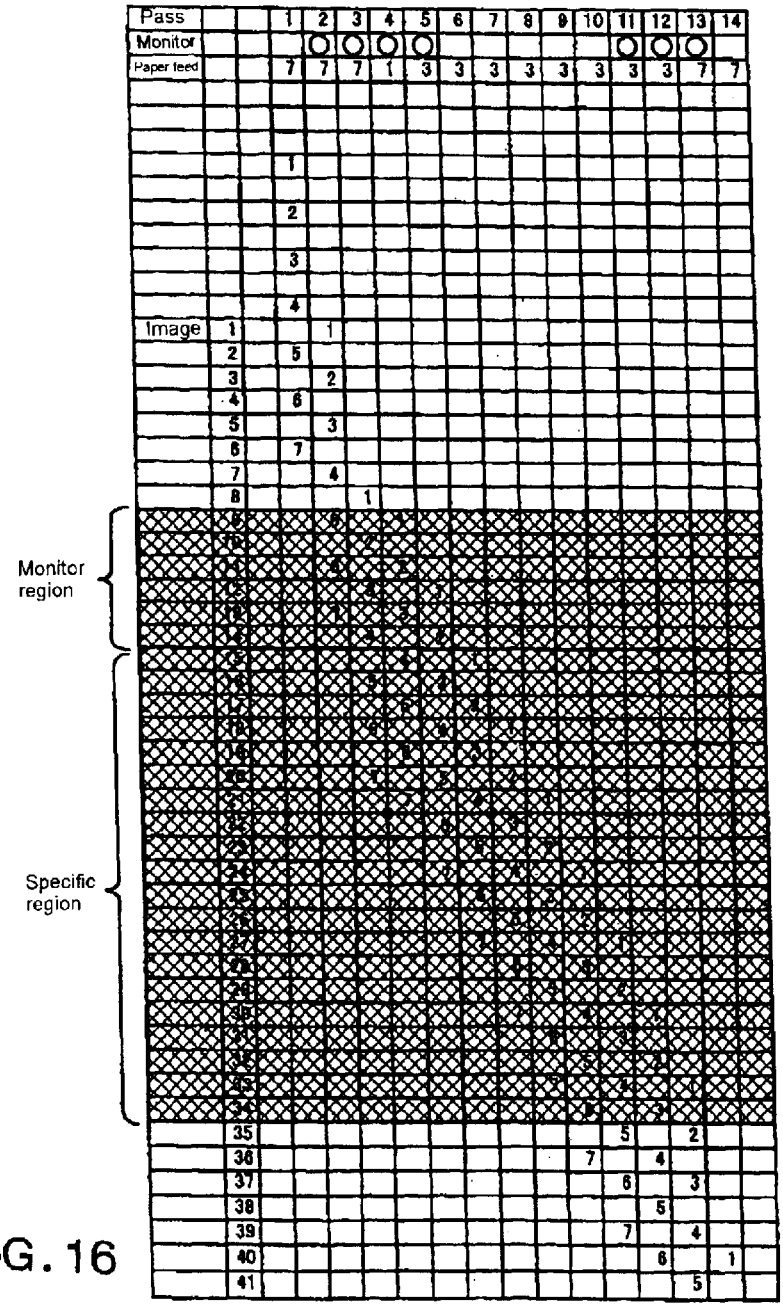
FIG. 16 is a diagram showing one mode of printing in which a specific region is combined with a band region.
Figure 17:
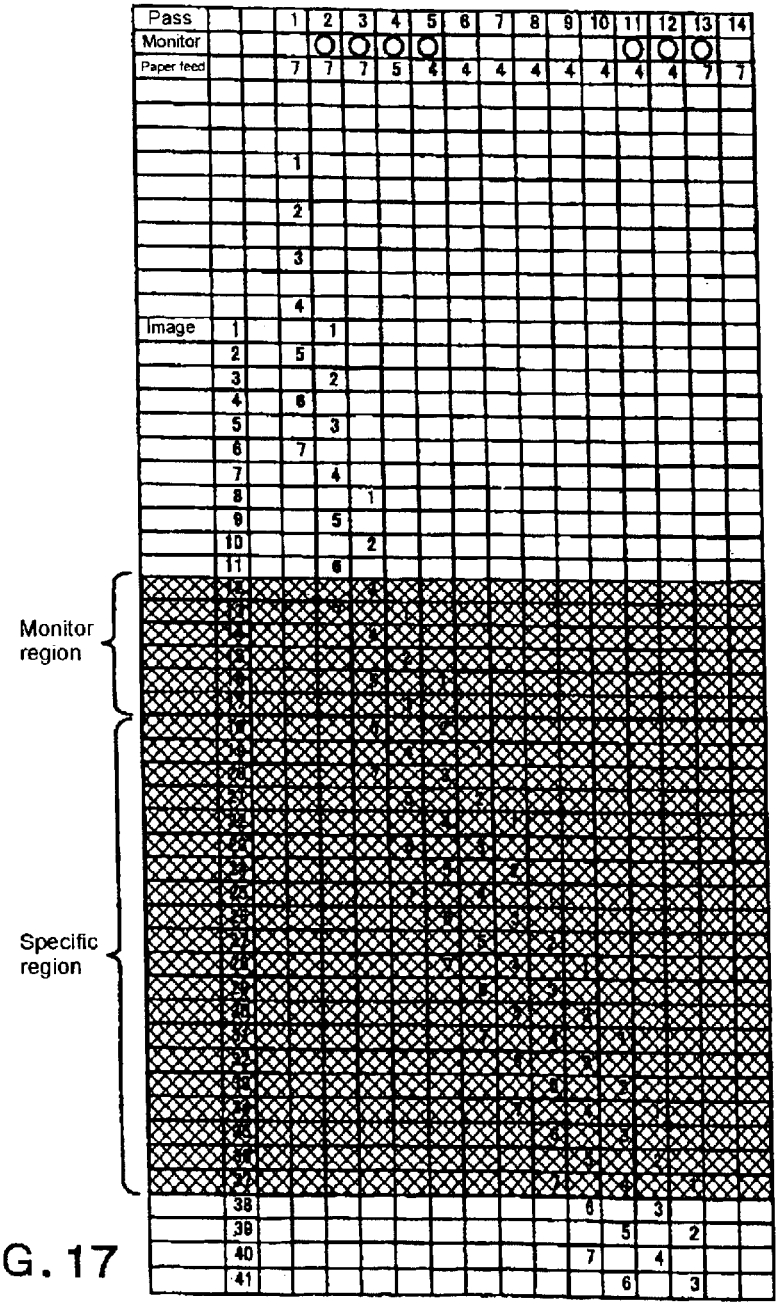
FIG. 17 is a diagram showing another mode of printing in which a specific region is combined with a band region.

Here, FIGS. 16 and 17 show the printing state due to the combination of the specific region and the band region. In FIG. 16, it is constructed such that the first line of the specific region (or the image line 15) is positioned at the image line 2 in FIG. 12. Also, it is shown that the seventh nozzle in the third pass in FIG. 17 becomes the nozzle for the print ratio of 1/2 in correspondence with FIG. 12.

(5) Processing Not Involving the Print Monitor Mode

Figure 18:
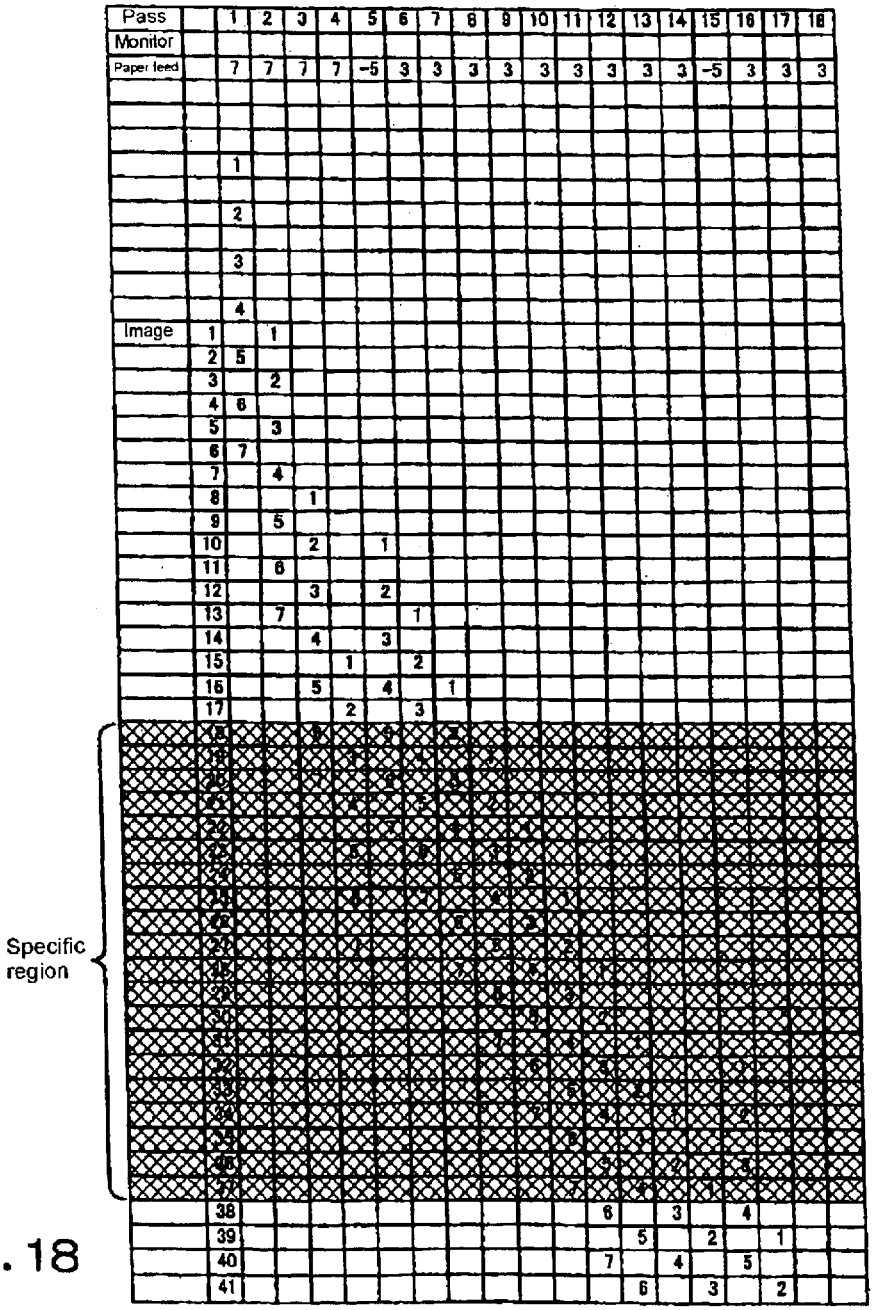
FIG. 18 is a diagram showing the mode of printing in which printing is performed in the other region after printing has been performed in each region.
Figure 19:
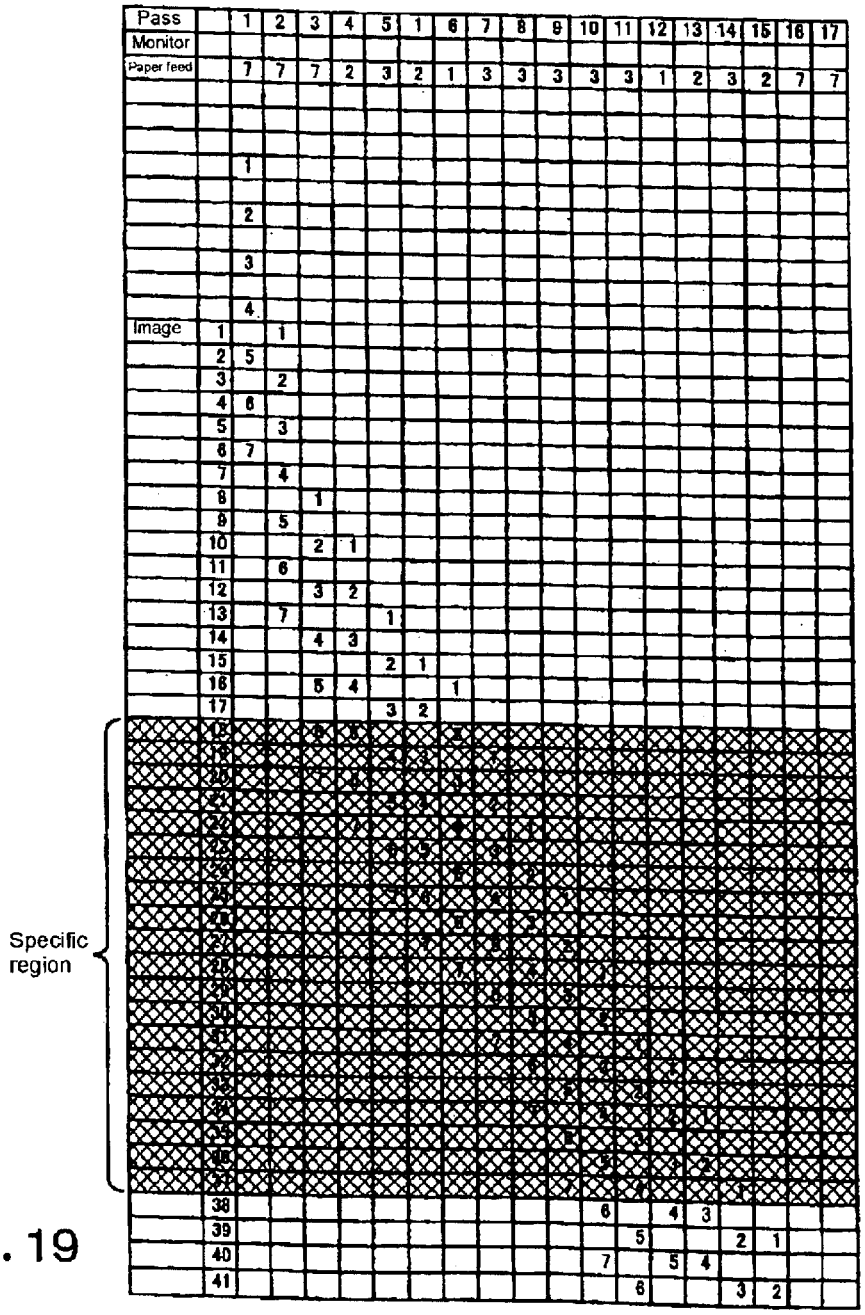
FIG. 19 is a diagram showing the mode of printing which prevents paper from being fed backward.

The following describes the method of moving to the other region after the completion of printing in each region (the specific region and other regions). FIG. 18 shows printing under the same condition as shown in FIG. 19. In FIG. 18, printing in the normal mode for the image lines 1 to 17 is completed by the first to fourth passes. In the first to fourth passes, printing in the overlap mode is not performed for the image lines 18 to 37. Printing in the overlap mode for the specific region is performed anew in the fifth pass. In the period from the fifth pass to the fourteenth pass, printing of the specific region constructed of the image lines 18 to 37 is completed in the overlap mode.

In the period from the fifth pass to the fourteenth pass, printing in the normal mode is not performed. If this is adopted, the direction of paper feed is reversed in the fifth pass and the fifteenth pass. Reversing paper feed accurately is very difficult to achieve and leads to a cost increase. Here, the reversal of paper feed is eliminated by replacing the printing order of pass as shown in FIG. 19. The algorithm employed in this case is explained in the following.

(a) When the band region begins to overlap with the specific region, it does not perform printing but stores the rasterizing data until the mode is switched over.

(b) After the mode has been switched over, it starts printing in the order of the high image position of the first nozzle.

In the above-foregoing there were shown the printing method in the print monitor mode and printing method in the mode which completes printing for each region without print monitoring. Here, in the mode which does not involve print monitoring, it is understood from FIGS. 18 and 19 that there is a difference equivalent to four passes in printing the same region. Thus, the former leads to better nozzle efficiency, permitting images to be printed with a less number of passes. Therefore, it is possible to increase the printing speed if the computer 90 has a sufficient capability to execute the print monitor mode. On the other hand, the latter does not need the print monitor mode; therefore, it is possible to realize with a simple circuit construction at a low cost. However, the printing process is slow because there are more passes than the former.

The construction adopted in this embodiment is such that the specific region in which printing is performed in the overlap mode is formed with specific image lines based on the judgment of pixel data in step S225. The technique of forming the specific region to be printed in the overlap mode in this manner is not limited to the technique of determining on the basis of the properties of the pixel data. It is possible to adopt the technique of constructing the specific region on the basis of the user's specification.

Figure 20:
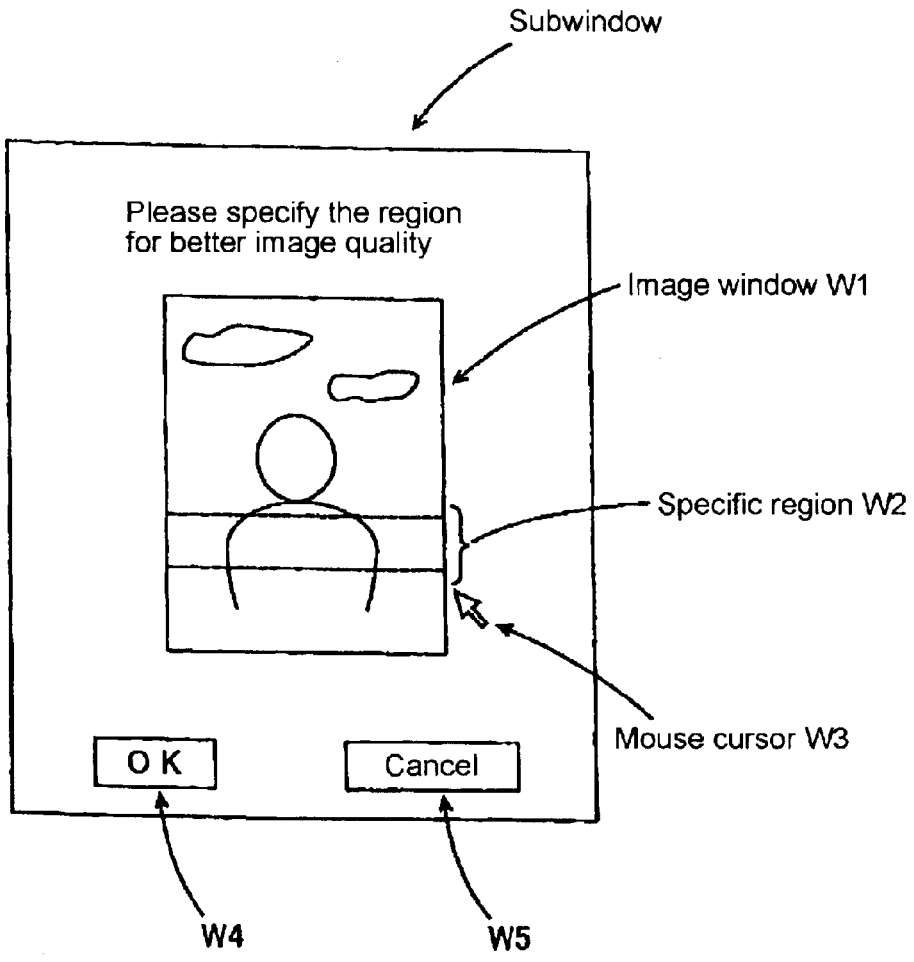
FIG. 20 is a diagram showing one example of interface used to specify a specific region.

FIG. 20 shows an example of the interface that appears on the screen when the user specifies the specific region. When the user executes the prescribed function possessed by the printer driver 96, the subwindow W appears in the display 21. This subwindow displays a message saying "please specify the region for better image quality", thereby prompting the user to specify the specific region to be printed in the overlap mode. The subwindow also displays the image window W1 which shows the image data for printing. Here, the user executes the prescribed operation by utilizing the mouse cursor W3, thereby specifying the specific region W2 in the image window W1. After completion of this step, the user selects "OK" W4. On the other hand, to reset the specific region W2, the user selects "cancel" W5. If "OK" W4 is selected, this specific region W2 is established as the specific image line, and printing in the overlap mode is executed.

(6) Summary

As mentioned above, the print control apparatus performs the image judging processing as the preliminary processing for the dot-forming control processing, and it generates the printing condition to specify whether to perform printing in the normal mode for each image line or to perform printing in the overlap mode for each image line. And, it performs the rasterizing on the basis of this printing condition. If it prints in the overlap mode the image line containing print pixels (such as black pixels and pixels having approximately the same resolution) subject to banding, then it is possible to prevent the occurrence of banding even though other image lines are printed at a high speed in the ordinary printing manner. Therefore, it permits high-quality high-speed printing.

What is claimed is:

1. A print control apparatus which causes a print head to print pixels constituting each image line during its primary scanning, said print head having columnarly arranged nozzles to eject different color inks according to printing data, said print control apparatus comprising an image line judging unit to judge whether or not a prescribed printing condition holds for the image line to be printed and a print control unit to change the number of nozzles to be used for printing each image line depending on whether or not said printing condition holds.

2. The print control apparatus as defined in claim 1, wherein the print control unit causes N nozzles to be used for the printing of an image line for which the printing condition does not hold and also causes N+1 or more nozzles to be used for the printing of an image line for which the printing condition holds.

3. The print control apparatus as defined in claim 1, which further comprises a printing condition specifying unit which specifies the printing condition requiring a change to be made in the number of nozzles to be used for a specific image line.

4. The print control apparatus as defined in claim 1, which the image line judging unit judges whether or not the image line contains specific print pixels as the print condition.

5. The print control apparatus as defined in claim 4, wherein the print control unit causes an image line to be printed with N+1 or more nozzles if the image line judging unit judges that the image line contains print pixels to be formed in a specific dot pattern.

6. The print control apparatus as defined in claim 5, wherein the print pixel is formed with dots whose size is approximately equal to the resolution interval.

7. The print control apparatus as defined in claim 5, wherein the print control unit causes an image line to be printed with N+1 or more nozzles if the image line is recorded with specific dot species in a ratio higher than specified.

8. The print control apparatus as defined in claim 4, wherein the print control unit causes the image line to be printed with N+1 or more nozzles if the image line judging unit judges that the image line contains print pixels formed with a prescribed ink.

9. The print control apparatus as defined in claim 8, wherein the print pixels are formed with a black ink.

10. The print control apparatus as defined in claim 1, which further comprises a region storage unit to store the region of the image line for which the printing condition holds.

11. The print control apparatus as defined in claim 1, wherein the print control unit has the image line print storage unit which stores the image line which has been printed, and the nozzles facing the image line stored in the image line print storage unit are made inoperable at the time of printing.

12. The print control apparatus as defined in claim 11, wherein the image line print storage unit sets up the print finish monitor region which monitors whether or not printing around the image line including the printing pixels has been completed and this print finish monitor region stores the image line.

13. The print control apparatus as defined in claim 12, wherein the print finish monitor region is established sufficiently above the image line including the print pixels.

14. The print control apparatus as defined in claim 12, wherein the print finish monitor region corresponds to the number of nozzles arranged in the nozzle column.

15. The print control apparatus as defined in claim 1, wherein the print control unit performs printing for the other image region after completion of printing on either of the image region formed by the image line containing the print pixels or the image region formed by the other image line.

16. The print control apparatus as defined in claim 1, wherein, in the case where return occurs in the nozzle column when printing is performed on the other image region after completing printing for either the image region formed by the image line containing the print pixel or the image region formed by the other image line, the print control unit keeps the print data when primary scanning is carried out to the state in which no return of the nozzle column occurs and causes the image line to be printed according to the same printing data while rearranging the order of primary scanning so that no return of the nozzle column occurs.

17. A print control method which causes a print head to print pixels constituting each image line during its primary scanning, said print head having columnarly arranged nozzles to eject different color inks according to printing data, said print control method comprising an image line judging step to judge whether or not a prescribed printing condition holds for the image line to be printed and a print control step to change the number of nozzles to be used for printing each image line depending on whether or not said printing condition holds.

18. The print control method as defined in claim 17, which further comprises a printing condition specifying step which specifies the printing condition requiring a change to be made in the number of nozzles to be used for a specific image line.

19. A medium storing a print control program which causes a print head to print pixels constituting each image line during its primary scanning, said print head having columnarly arranged nozzles to eject different color inks according to printing data, said print control program making the computer to realize an image line judging function to judge whether or not a prescribed printing condition holds for the image line to be printed and a print control function to change the number of nozzles to be used for printing each image line depending on whether or not said printing condition holds.

20. The medium storing a print control program as defined in claim 19, which further comprises a printing condition specifying function which specifies the printing condition requiring a change to be made in the number of nozzles to be used for a specific image line.

* * * * *